US005913796A

United States Patent [19]

Emigh

[11] Patent Number: 5,913,796

[45] Date of Patent: Jun. 22, 1999

[54] SHEET PACKET HOLD-DOWN APPARATUS

[75] Inventor: Jonathan D. Emigh, Somerset, Calif.

[73] Assignee: International Billing Services, Inc., Rancho Cordova, Calif.

[21] Appl. No.: 08/707,480

[22] Filed: Sep. 4, 1996

[51] Int. Cl.[6] ..... B65B 43/26; B65B 61/20

[52] U.S. Cl. ..... 53/284.3; 53/569; 271/250

[58] Field of Search ..... 53/284.3, 460, 53/475, 569; 271/15, 128, 160, 250

[56] References Cited

U.S. PATENT DOCUMENTS

| | | | |
|---|---|---|---|
| 2,938,723 | 5/1960 | Paulson | 271/250 |
| 3,936,993 | 2/1976 | Dorer | 53/284.3 |
| 4,932,188 | 6/1990 | Krasuski et al. | 53/284.3 X |
| 4,955,185 | 9/1990 | Haas et al. | 53/284.3 X |
| 5,284,004 | 2/1994 | Metzler | 53/284.3 X |
| 5,555,701 | 9/1996 | Fehringer et al. | 53/284.3 X |
| 5,577,719 | 11/1996 | Nicoll | 271/250 X |
| 5,581,972 | 12/1996 | Antonelli | 53/284.3 X |

*Primary Examiner*—John Sipos
*Attorney, Agent, or Firm*—James M. Ritchey

[57] ABSTRACT

For use with an envelope inserter, a sheet packet hold-down apparatus, comprising a stopping mechanism or guide for stopping the leading edge of the sheets, a hold-down button of substantially hemispherical shape, wherein the hold down button is positioned before the stopping mechanism or guide, a bias device for resiliently supporting the hold-down button, and a conveyor apparatus for transporting the sheets to the stopping mechanism or guide.

26 Claims, 6 Drawing Sheets

SHEET PACKET HOLD-DOWN APPARATUS

BACKGROUND OF THE INVENTION

1. Field of the Invention

The invention pertains generally to devices and methods for directing and stabilizing moving assemblies or packets of sheets, pages, or forms, and more particularly to a sheet packet hold-down apparatus which avoids paper jams associated with fanning or flaring of the edges of sheets within a packet of moving sheets or to be moved sheets.

2. Description of the Background Art

Large scale, high volume mailing operations, such as the issuance of periodic billing statements or mass advertising, are generally carried out by mail processing and mail assembly systems which facilitate several mail preparation steps. Operations carried out by such mail processing systems typically include the printing, organizing, collating, and folding of mail materials, insertion of the mail materials into envelopes, envelope sealing, postage metering, and other operations. The mail materials generally comprise monthly or periodic billing and account statements, notices, flyers, advertising materials, return envelopes, and like items. Mail processing and assembly operations are frequently carried out under computer control, which permits high speed mail preparation.

In high speed mail preparation operations, the sheets of mail materials are usually moved or transported by conveyor belt systems and/or along chutes. Guide members, stabilizing brushes, and compressed air and vacuum means are generally utilized to stabilize and provide direction to the traveling sheets. Despite these measures, when sheets are moving at high speeds there generally occurs a flaring or fanning apart of the sheets due to aerodynamic interactions, particularly at the leading edges of the sheets. In moving sheet assemblies, the orientation of the sheets relative to each other is generally not uniform along the front or leading edge of the assembly, with some sheets ahead of or trailing others, and some sheets angularly displaced relative to the other sheets. It is also possible for a sheet or sheet assembly to travel in a slightly skewed manner wherein the leading edge of the sheet or sheets is off-normal relative to the direction of travel.

At various stages in high speed mail processing operations, one or more sheets which are traveling at relatively high speeds must be stopped or slowed down in order to carry out mail processing steps. For example, the collation of sheets generally requires that a stream of rapidly moving sheets be stopped and registered along an edge, generally by coming to rest along the leading edge against a stopper or stopping member, to form a collated stack of sheets. The stack or collection of sheets may then be placed in motion again and directed to other processing operations such as folding or insertion into envelopes.

A particular problem in mail processing is associated with the stopping of sheets and assemblies or packets thereof which are moving at high speeds. Since the packet of sheets tends to flare at the leading and trailing edges and also tend to become displaced relative to each individual sheet within the packet during travel as mentioned above, one or more sheets may be deflected above a suitable position of advancing to a subsequent position in processing or be stopped in a position or positions which are displaced relative to the rest of the sheet assembly. Such incorrect and non-uniform stopping of sheets and sheet packets results in paper jams in the machinery of the mail preparation process, causing system shutdowns and delay while an operator clears the jams.

One approach to remedying the aforementioned problem has been the utilization of button-type hold-down devices in association with the stopping of rapidly moving sheets and sheet assemblies during mail processing. A button hold-down device generally comprises a downwardly disposed button or tab which is mounted on bias means such as a resilient arm. The button is generally used in conjunction with an overhead plate to contain the moving sheet or sheet assembly, with the button located within and downwardly suspended through a bore or aperture in the plate. The button hold-down device is generally deployed in a position which is slightly upstream from a stopper or guide member upon which at least one leading sheet edge of the packet usually, though not necessarily, hits (assists in guiding the sheets into the envelope). The assembly or packet of moving sheets usually registers a trailing edge against the dogs that catch and move the sheets under the button hold-down device. The leading edges of the traveling sheets may come into contact with and do pass beneath the button prior to usually at least one leading edge reaching the stopper or guide. The button serves to reduce or correct the flaring and/or disorientation of sheets at the edges of the packet assembly. The bias arm, holding the button, allows the button to yield in an upward direction, so that the sheets are not stopped by the button but can proceed on to stop at or near the stopper or guide (if a particular sheet is not long enough to actually hit the stopper or guide, as delivered by the dog, it may come to rest short of the stopper or guide but under the button) after correction of the flaring by downward pressure from the button.

In the background art button hold-down devices, buttons of generally cylindrical structure and configuration have been employed, with a tapered face oriented in the direction from which the moving sheets will arrive. The background art button configuration is deficient, however, in that moving sheets and sheet assemblies tend to catch upon the button and jam, requiring shutdown of the mail preparation process while the jam is cleared by an operator. The aforementioned hold-down button configuration is particularly prone to causing jams with a sheet assembly wherein one or more sheets are skewed or angularly displaced relative to each other comes into contact with the hold-down button.

A further deficiency associated with background art hold-down devices is the lack of any control over lateral flaring or fanning of the paper sheets. Such control of flaring of sheets along lateral edges is important in mail processing operations wherein the sheet assemblies are transferred in a lateral direction after stopping. Control of lateral flaring is particularly important where one or more sheets in a moving sheet assembly have been previously folded, which tends to increase the amount of flaring or fanning opposite to the fold.

Accordingly there is a need for a sheet packet hold-down apparatus that stabilizes and orients a moving sheet or sheet assembly prior to inserting into a mailing envelope, which eliminates or controls fanning or flaring of sheets at both the leading edge and a lateral edge, and which does not experience paper jams. The present invention satisfies these needs, as well as others, and generally overcomes the deficiencies found in the background art.

SUMMARY OF THE INVENTION

An object of the invention is to provide a sheet packet hold-down apparatus for moving sheets and sheet assemblies which stabilizes and orients the assemblies prior to inserting into the mailing envelope.

Another object of the invention is to provide a sheet packet hold-down apparatus for moving sheets and sheet packet assemblies which eliminates flaring or fanning of sheets at the edges of the packet assemblies prior to inserting into the mailing envelope.

Yet another object of the invention is to provide a sheet packet hold-down apparatus for moving sheets and sheet packets which is suitable for use with envelope insertion, collation, folding, and transfer operations in mail processing.

A further object of the invention is to provide a sheet hold-down invention which contains or controls flaring or fanning of sheets along a lateral edges as well as the leading and trailing edges.

An additional object of the invention is to provide a sheet packet hold-down apparatus which provides for quick and efficient lateral transfer of sheets and sheet assemblies subsequent to stopping.

Still another object of the present invention is to provide a sheet packet hold-down apparatus which does not cause jamming of moving sheets and sheet packet assemblies.

Further objects of the invention will be brought out in the following portions of the specification, wherein the detailed description is provided for the purpose of fully disclosing the invention without placing limits thereon.

Disclosed is a sheet packet hold-down apparatus which contains, corrects, or controls flaring, fanning, and non-uniformly oriented sheets and sheet assemblies to prevent the jamming of sheets associated with stopping of moving sheets. In general terms, the invention comprises a hold-down button of generally hemispherical shape, bias means for resiliently supporting the hold-down button, and guiding or guiding means for halting the sheets or sheet packets and assisting in guiding them into an envelope. The invention also preferably comprises plate means for downward suspension of the hold-down button, and conveyor means for transporting sheet assemblies to the guiding means and hold-down button. Pusher means for pushing sheets away from the stopper means may be included with the invention for lateral transfer of the sheets after the stopping thereof. Preferably, means for containing or overcoming lateral flaring of sheets are included with the pusher means of the invention.

By way of example and not of limitation, the hold down button has a generally hemispherical shape with a shallow angle of arc. The bias means preferably comprises first and second bias means in the form of first and second resilient arms of thin gauge steel or other metal, with a first arm resiliently supporting or suspending the hold-down button, and a second arm positioned above the first arm and hold-down button. The plate means preferably comprises a metal plate with an aperture therein, with the aperture structured and configured to allow the hold-down button to be downwardly suspended by the bias means. The plate means, in conjunction with the conveyor means, generally define a chute or travel path for moving sheets which terminates at the guiding means. The plate means includes an aperture through which the hold-down button is vertically suspended by the bias means. The guiding means preferably comprises a stopper or stopping member having an edge or surface which is structured and configured to stop the leading edge or edges of usually one or more sheets within the packet. The pusher means preferably comprises a pusher arm with one or more pusher fingers having means for containing or controlling lateral flaring of sheets and/or disorientation associated with the plurality of sheets within sheet assemblies. The containing means preferably comprises elongated, substantially vertical members associated with the pusher fingers, with the elongated members each including generally flat sheet-facing surface.

BRIEF DESCRIPTION OF THE DRAWINGS

The invention will be more fully understood with reference to the following drawings, which are for illustrative purposes.

DESCRIPTION OF THE PREFERRED EMBODIMENT

Referring more specifically to the drawings, for illustrative purposes the subject invention is embodied in the folding apparatus which is shown generally in FIG. 4 through FIG. 9. The sheet packet hold-down apparatus comprising the invention is, for reasons of clarity, disclosed in terms of a conventional envelope insertion operation as is frequently used in mail assembly and preparation processes. However, as should be readily apparent to persons of ordinary skill in the art, the subject invention may be used independently of an inserter apparatus, and may be used in association with collation, folding, sheet assembly transfers, or any other operation wherein rapidly moving sheets must be stopped and registered along an edge, usually a trailing edge that is aligned against a transporting dog. The terms "sheets," "sheet packet," and "sheet assembly" as utilized herein refer generally to paper sheets, forms, pages, envelopes, and collections thereof (see FIGS. 7A and 7B in which an assembly is depicted with the leading edges LE of the pages or sheets having minimal flaring in FIG. 7B, under the hold-down button, and extensive flaring in FIG. 7A, before the assembly reaches the hold-down button).

Figure 1:
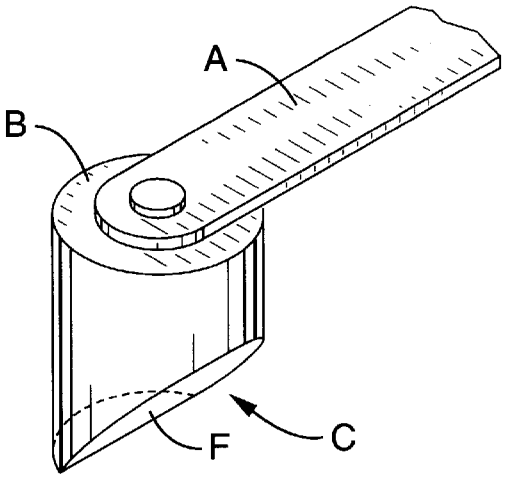
FIG. – 1 PRIOR ART
FIG. 1 is a perspective view of a PRIOR ART hold-down button attached to a supporting bias arm.
Figure 2:
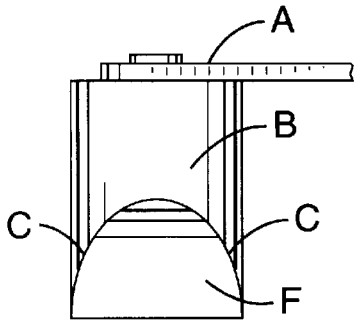
FIG. – 2 PRIOR ART
FIG. 2 is a side view of the PRIOR ART hold-down button of FIG. 1.
Figure 3:
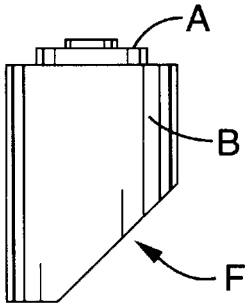
FIG. – 3 PRIOR ART
FIG. 3 is an end view of the PRIOR ART hold-down button of FIG. 1.

The invention will be more fully understood by referring first to FIG. 1, FIG. 2, and FIG. 3 wherein is shown a PRIOR ART hold-down button B. Button B is of generally cylindrical shape, and includes a vertically tapered face F. Button B is resiliently supported by arm A, and is generally suspended vertically in front of a stopper or guide (not shown). Tapered face F on button B is positioned away from the stopper or guide and facing towards oncoming moving sheets (not shown). As aforementioned, the leading edges of traveling sheets tend to flare or fan out, and may be deflected over a stopper or guide, causing a paper jam at the stopper (note that the trailing edges often flair too). Tapered face F is provided to deflect the flaring leading edges of traveling sheets downward, so that the sheets correctly fit within the stopper or guide rather than be deflected above the stopper or guide. As an edge or edges of the packet come into contact with tapered face F on button B, button B moves upward so that the sheets may proceed under button B. Resilient arm A provides downward pressure on the top of the sheets as they pass below button B, reducing fanning or flaring of the sheets. Once the sheet or sheets have moved past button B, the button B is dropped back down into position by resilient arm A for the next sheet or sheets.

The PRIOR ART hold-down button shown in FIG. 1 through FIG. 3 is deficient in that sheets and collections of sheets tend to catch and jam upon button B, particularly when one or more sheets are angularly displaced relative to each other and to the direction of travel. When the leading edge of a sheet or sheets is angularly displaced from the direction of travel (i.e., the leading edge is off-normal to the direction of travel), the leading edge does not directly come into contact with tapered face F, but instead comes into contact with the relatively sharp corners C on the edges of face F. Corners C on button B do not effectively deflect the leading edges of sheets, but instead cause the sheets catch upon corners C, resulting in paper jams and shutdown of the mail preparation operation.

Referring now to FIG. 4 through FIG. 9, there is shown the subject sheet packet hold-down apparatus 10 which overcomes the deficiencies associated with the PRIOR ART hold-down button described above.

Figure 4:
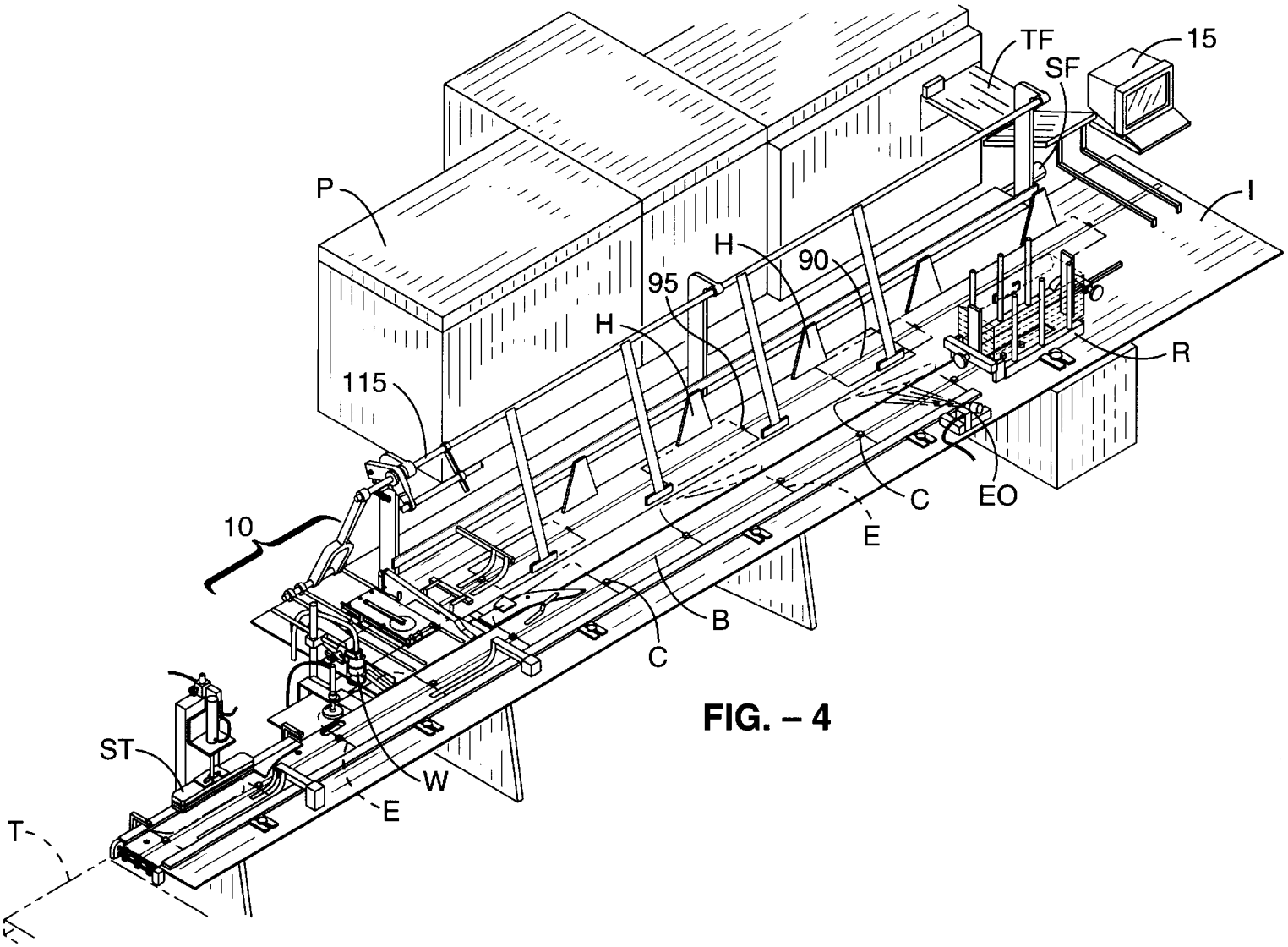
FIG. 4 is a perspective view of a hold-down button and bias means associated therewith in accordance with the sheet packet hold-down apparatus of the present invention.

Referring first to FIG. 4, the subject apparatus 10 is shown in conjunction with a conventional inserter I in a standard mail preparation system. Generally, the subject apparatus 10 and inserter I are utilized in connection with a mail assembly system that assembles mailing pieces for bulk mailing operations. An assembled mailing piece generally comprises an outer mailing envelope, internal forms or folded pages (such as detailed and summary billing statements), inserts (such as advertisements, notices, and the like), a return envelope, and similar items. Usually, the mailing piece assembly system comprises a forms or pages source such as a printer P, means for folding or a transport assembly for transferring the forms or pages to subsequent equipment TF, a traditional envelope inserter machine I that places various hopper H held inserts into a mailing envelope E, and a transport T apparatus for subsequent processing of the stuffed and sealed envelopes.

Usually, a typical mailing piece comprising a bill from a product or service provider is assembled as follows: 1) detailed and summary statement sheets are printed in the high speed printer P; 2) the statement sheets are folded by suitable means TF and transferred to the inserter machine I and collected in with the subsequent inserts; 3) from a mailing envelope rack R, mailing envelopes E have their flaps opened by a envelope flap opener EO and are moved across the upper surface of the inserter I by appropriate means such as a conveyor system having a moving chain or belt B system with holding means such as claws C for catching each envelope E; 4) single or multiple inserts are supplied via the various hoppers H and associated mechanisms and to form a sheet assembly which transported by conveyor means to the guiding means of the invention, at which point the moving sheet assemblies are stopped, as discussed further below; 5) envelopes E are conveyed past the pusher means of the subject invention, as discussed below, wherein the stopped sheet assemblies are inserted or otherwise placed into envelopes; 6) each stuffed envelope is moved to a flap wetting apparatus W for activating adhesive on the envelope flaps, and a sealing apparatus ST which seals the stuffed envelopes (an encoding device is often included for dating or marking each envelope); and 7) the assembled mailing piece is placed in a transport T apparatus for subsequent processing. While the above scheme is a common mail assembly pathway, it is but one of many assembly pathways contemplated wherein the subject invention may be utilized. A variety of simpler and more complex mail processing operations may utilize the sheet packet hold-down apparatus comprising the present invention. Since envelope insertion is a standard application wherein stopping of moving paper sheets is required, the above example is provided to exemplify a preferred manner of using the subject invention.

The above mail preparation operation generally includes a controller means for overseeing mail assembly. Although the controller means may be any now known or later developed hardwired or equivalent means, preferably, the controller means is a computer 15 programmed to monitor and direct the assembly of each mailing piece according to appropriate data base and equivalent information. The computer 15 is normally used by an operator and is a stand alone unit or linked directly or indirectly to additional hardware and software, or the equivalent, having additional information and controlling routines. The computer 15 monitors and directs, usually in cooperation with the operator, the various phases of the assembly process.

Since the computer 15 oversees the assembly process, the location of each item comprising the mailing piece is carefully tracked. The computer is configured and equipped with appropriate input devices to detect various errors such as mismatched forms, inserts, envelopes, and the like. Such error detection devices include readers (bar code readers and the like) that scan for indicia encoded forms, envelopes, inserts, and the like, and/or photocells to verify that correct items are within each mailing piece. When errors are encountered by the computer 15, the assembly process can be halted or allowed to proceed, depending upon an operator's election or standard protocol.

The subject computer 15 establishes the locations for the various mailing pieces and items to go within mailing pieces by tracking encoded indicia at known positions in the apparatus, by detecting the presence or absence of mail items with photocells, and/or by utilizing the machine cycle of the typical inserter I. A typical inserter I includes a central rotating timing and drive shaft (not shown) that operates the insert hoppers H, conveyor belt B, mailing envelope opener EO, and the pusher means and conveyor means of the invention, as described below. Encoder means, such as standard shaft encoder SF, is coupled to the inserter's central timing shaft and measures rotational angles of the timing shaft to monitor the machine cycle of the inserter and thus fix the position of any item on the inserter I. Shaft encoder SF is interfaced with computer 15 and relays positional information thereto. The encoder means may alternatively be an encoder included directly within a motor (not shown) which drives the inserter I. Combining the established locations for the error detection scanners and photocells with the information derived from the shaft encoder SF allows the computer 15 to monitor generally the position of each item associated with the mail assembly process.

Figure 5:
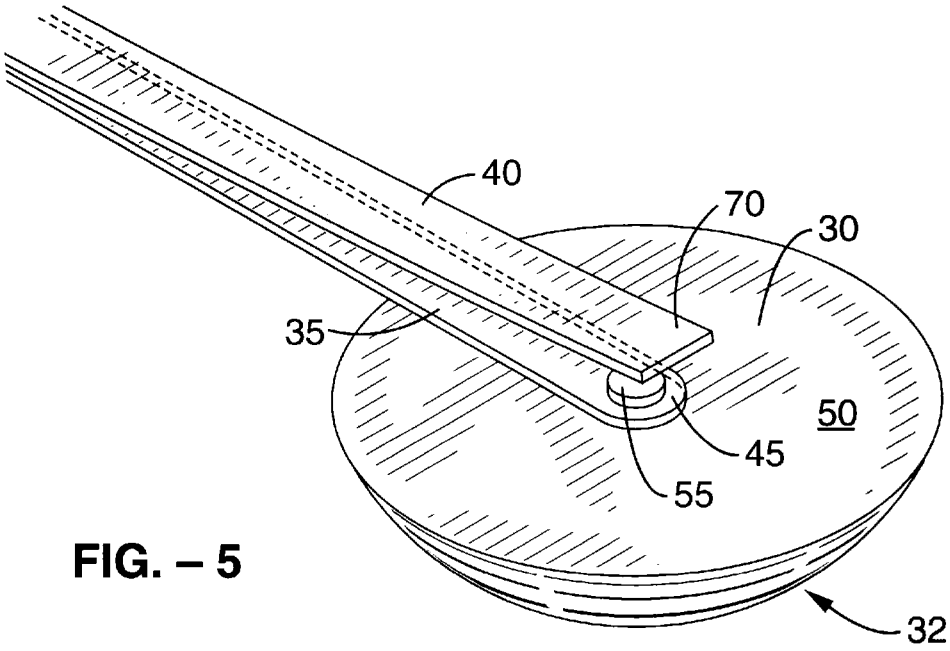
FIG. 5 is a perspective view of the sheet packet hold-down apparatus of the invention shown in conjunction with a conventional inserter machine.
Figure 6:
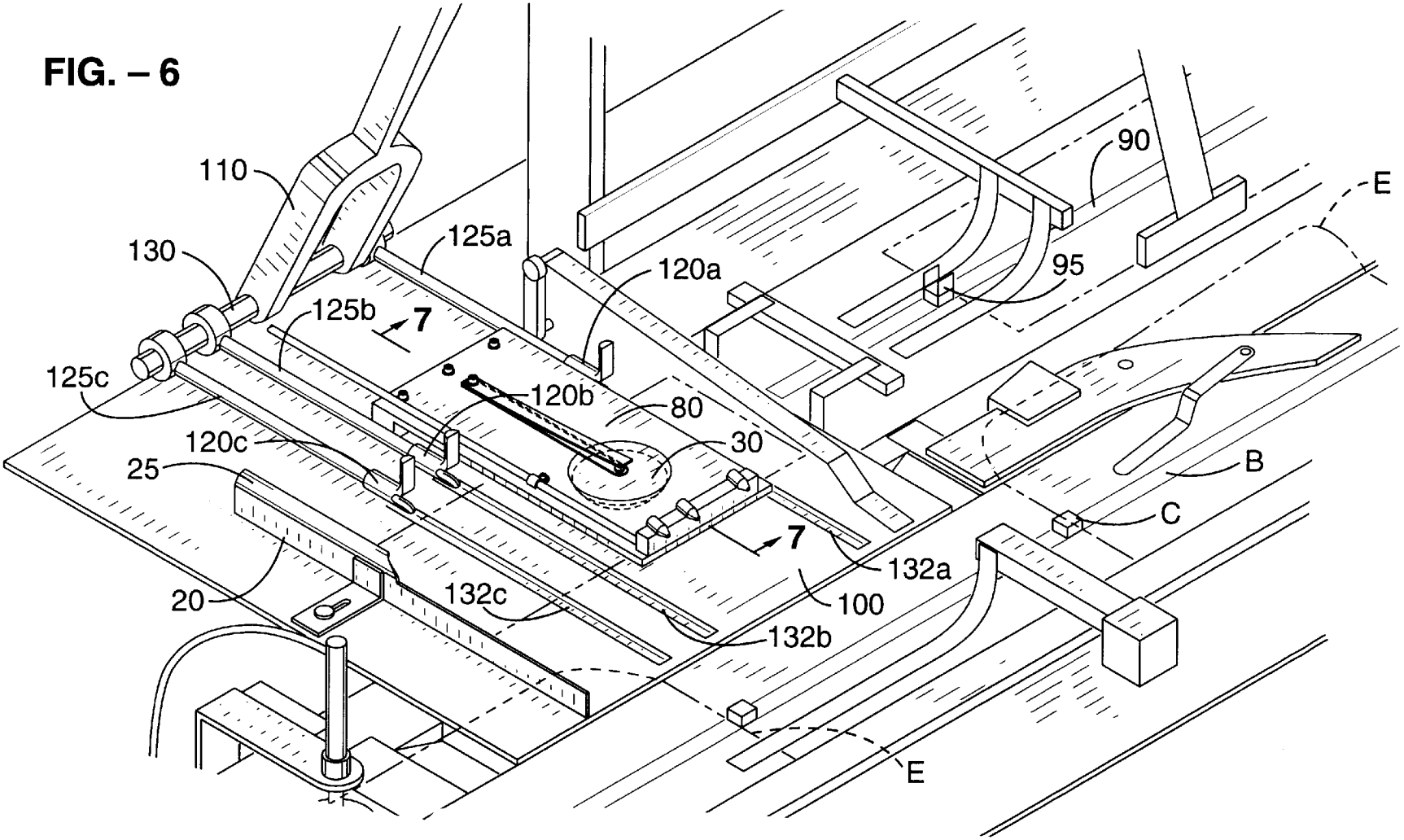
FIG. 6 is a detailed view of the sheet packet hold-down apparatus of the invention.
Figure 7A:
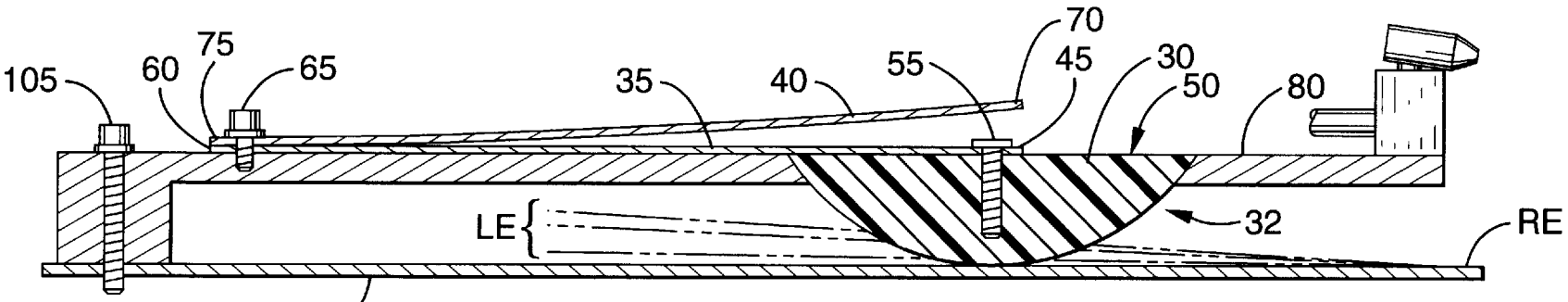
FIG. 7A and FIG. 7B provide a sectional view (viewed through line 7—7 in FIG. 6) of a hold-down button together with the bias means and plate means of the invention as the sheet assembly approaches 7A and as the sheet assembly is beneath the hold-down button 7B.
Figure 7B:
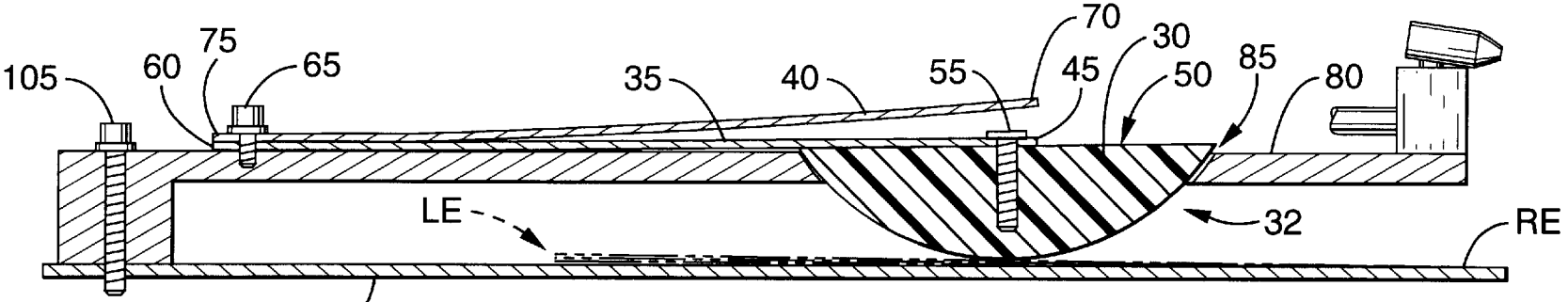
Figure 8:
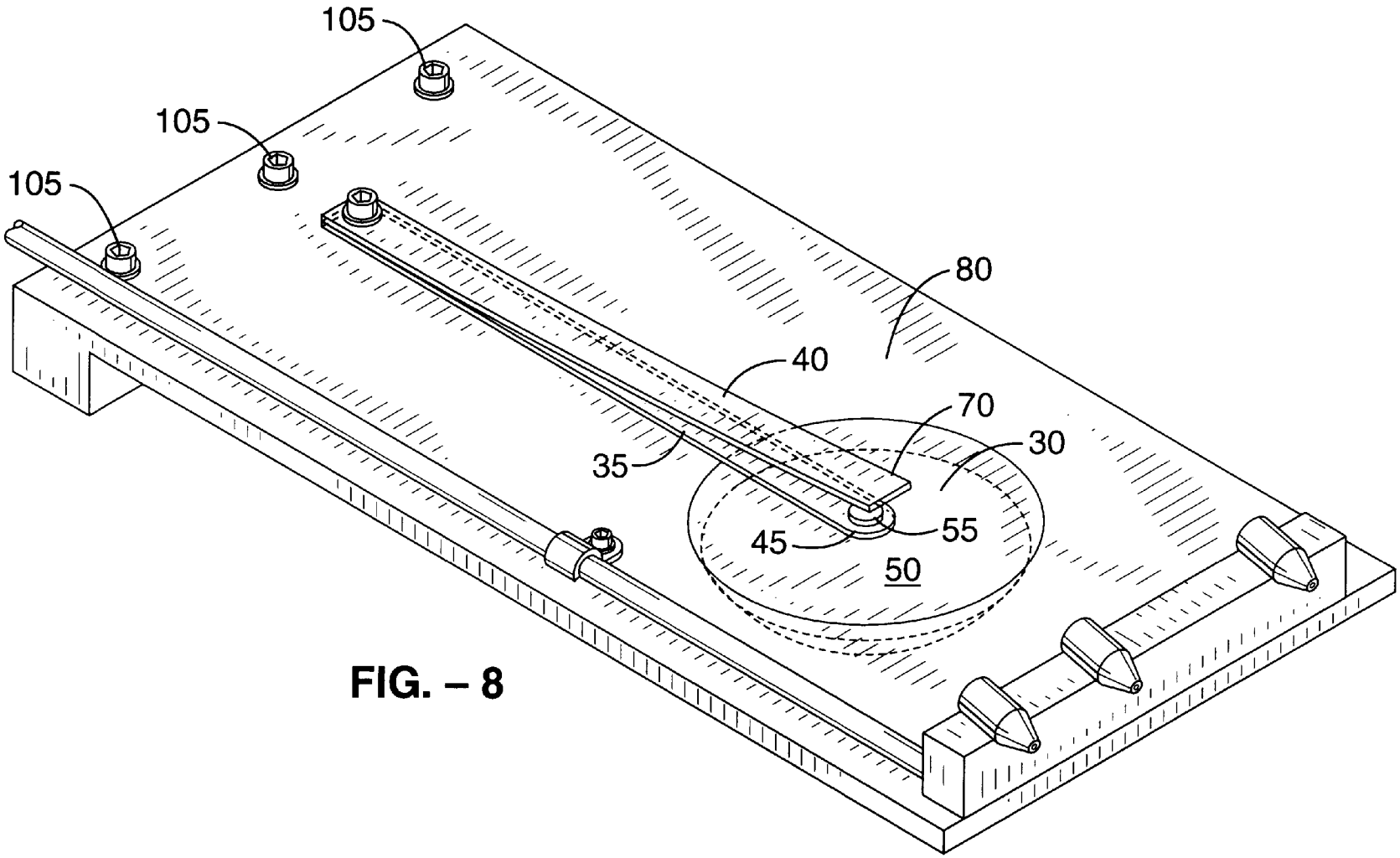
FIG. 8 is a perspective view of the hold-down button together with the bias means and plate means shown in FIG. 7A and FIG. 7B.

Referring now to FIG. 5 through FIG. 9 as well as FIG. 4, the sheet packet hold-down apparatus 10 comprising the present invention is related in more detail. Referring first to FIG. 6, the subject apparatus 10 includes stopping or guiding means for assisting in transporting the packet into the envelope, preferably in the form of stopping member, stopper, or guide 20. Stopper or guide 20 generally comprises a rectangular block or barrier which is structured, configured, and positioned to assist or guide the packet into the waiting envelop. Depending upon the actual length of any particular sheet within a packet, that sheet may hit the stopper or guide 20, but a shorter sheet within the same packet may not actually touch the stopper or guide 20. A variety of stopper configurations and shapes may be used with the subject invention, provided that the stopper or guide 20 includes a suitable surface for guiding the sheets. Stopper or guide 20 may be positionally adjusted by sliding mount 22 when screw 24 is loosened. A curved extension 25 is preferably included on stopper guide 20 to prevent sheets from passing over stopper or guide 20 and to assist further in guiding the packet into the envelope.

Referring now to FIG. 4 through FIG. 9, the subject invention also comprises a hold down button 30 of substantially hemispherical shape, with a lower curved surface 32 having a generally shallow angle of arc, as seen most clearly in FIG. 5. Hold-down button 30 is preferably fabricated from a light-weight, durable, wear-resistant, low-friction material such TEFLON, DELRIN polyacetal, PEEK polyether ether ketone, PPS polyphenylene sulfide, PES polyether sulfone, or like polymeric material. Due to ease of fabrication, DELRIN polyacetal is the presently preferred material for the hold-down button 30 of the invention. Metals may be used for the hold-down button 30, but are not preferred due to the greater weight associated with the metals.

Bias means for resiliently supporting hold-down button 30 are provided with the invention, and preferably includes both a first and a second bias means in the form of first and second bias arms 35 and 40 respectively, which are generally made of thin gauge steel sheet or other resilient metallic or polymeric material. First bias arm 35 is coupled at a first end 45 to the top surface 50 of hold-down button 30 by screw or fastener 55, or other attachment means, and is coupled at a second end 60 to the plate means of the invention, described below, by screw 65 or other fastening means. Second bias arm 40 has a free first end 70 positioned above hold-down button 30 and first end 45 of bias arm 35, and is coupled to the plate means at a second end 75 by screw 65. Screw 65 may serve as adjustment means for positionally adjusting the bias of bias arm 40. The bias means of the invention may alternatively comprise a coiled spring rather than bias arms 35, 40.

Plate means for downward suspension of the hold-down button 30 are generally provided with the invention. Preferably, the plate means comprises a horizontal plate 80 which includes an aperture 85 (FIG. 7B) through which hold-down button 30 is vertically suspended from the bias means. Bias arms 35, 40 are preferably mounted directly to plate 80 by screw 65, but may alternatively be mounted onto a surface of inserter I or other suitable structures.

Conveyor means for transporting sheets to the guiding means are generally included with the invention, and preferably comprises a chain, track, or belt system 90. Chain system 90 moves past hoppers H which, at the direction of computer controller 15, provide sheets of mail material to belt. A plurality of forks, tines, or dogs 95 are included on chain 90 which receive the sheets from hoppers H. Chain 90 terminates adjacent to a lower plate 100, which, together with plate 80, define a chute or channel through which sheets from belt 90 are directed towards stopper 20. Plate 80 is coupled to plate 100 by screw 105 or other fastening means. Plate 100 and plate 80 are vertically spaced apart far enough so that moving sheets may be directed between the plates without catching on the edges of plate 80, as seen most clearly in FIG. 7A and FIG. 7B. Sheet assemblies are shown generally in FIG. 7A (apporaching the hold-down button 30) and FIG. 7B (under the hold-down button 30) as folded along one edge, and fanned or flared out along an unfolded edge, as is discussed further below.

In operation, sheets or sheet assemblies held by dogs 95 are transported by chain 90 towards plates 80, 100 and stopper 20, where the sheets or sheet assemblies are sequentially delivered. As sheets or sheet assemblies leave chain 90 and dogs 95, the sheets slide across plate 100 and under plate 80 towards stopper or guide 20. As the sheets pass beneath plate 80, the leading edges of the sheets interact with hold-down button 30, as seen most clearly in FIG. 7A and FIG. 7B. Hold-down button 30, which protrudes downward through aperture 85 in plate 80, provides a generally hemispherical, arcuate, low-friction, curved lower surface 32 against which the leading edges of sheets are deflected downward. The action of button 30 against the leading edges of the sheets in the moving sheet assembly tends to hold down the sheets and eliminate fanning or flaring along the leading edge of sheets in the sheet assembly prior to the contacting of stopper 20 by sheet assembly, so that when the moving sheet assembly come to rest against stopper 20, no sheets are deflected over stopper 20. The hemispherical, arcuate shape of hold-down button 30 prevents jamming of sheets against plate 80, as there is no sharp edge or surface upon which the sheets may catch.

As moving sheets interact with the hold-down button 30, button 30 is pushed upward by the sheets. First bias arm 35 provides pressure downward on button 30 to aid in eliminating flaring of the leading edges of sheets, and to return hold-down button 30 into position. In the event that hold-down button 30 is pushed sufficiently hard, as may occur with a larger sheet assembly or when there is a high degree of flaring at the leading edge due to high travel speeds, the upper surface 50 of hold-down button 30 may come into contact with free end 70 of second bias arm 40, which provides additional downward pressure on button 30. The tightening or loosening of screw 65 may be used to adjustably position second bias arm 40, and may be used for fine tuning the amount of bias or downward pressure exerted by hold-down button 30 on sheets for particular mail processing operations.

Figure 9:
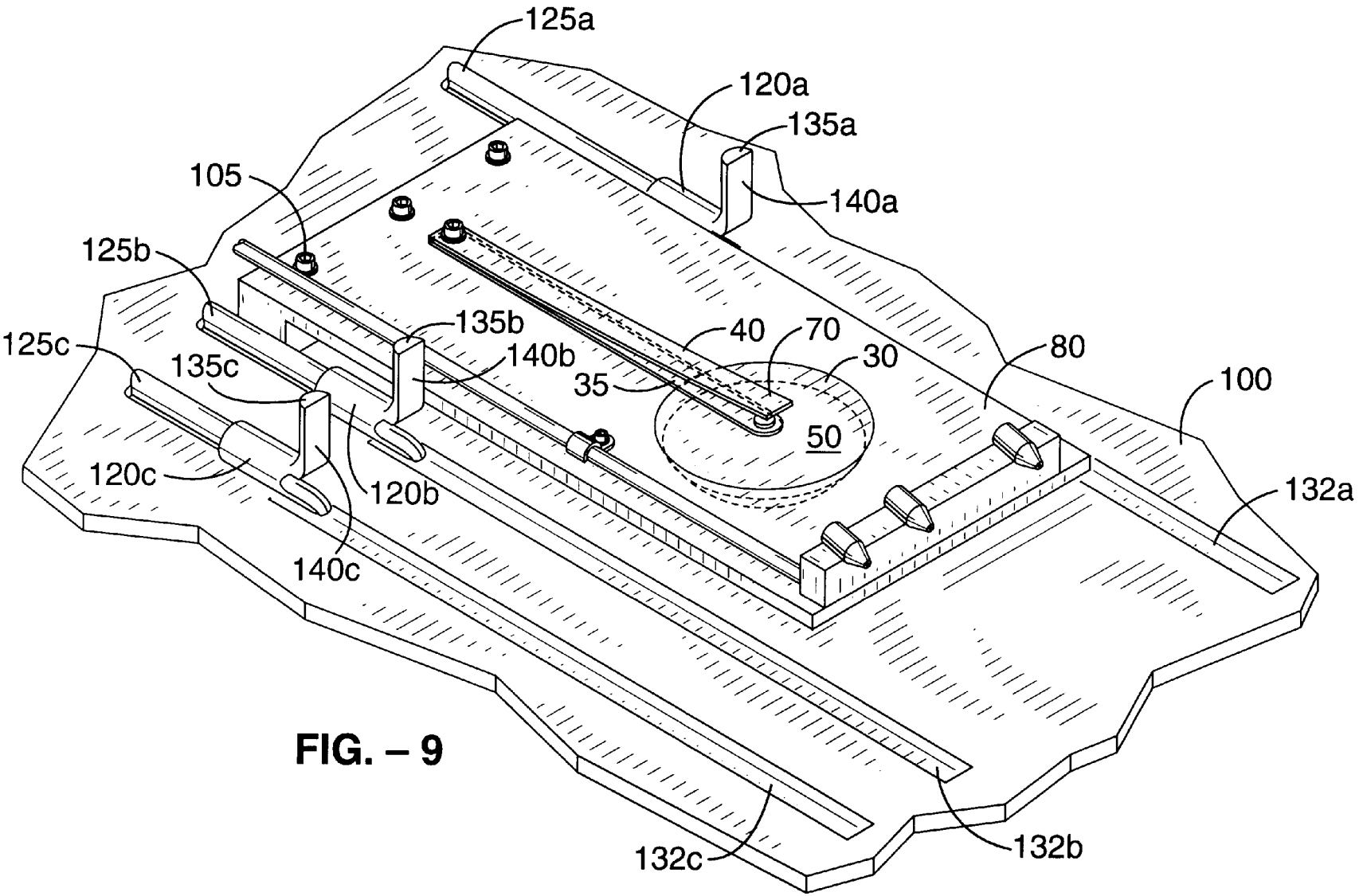
FIG. 9 is a perspective view of the hold-down button, bias means and plate means of FIG. 8, shown together with pusher fingers.

Generally, once the sheets or sheet packet or assemblies have been effectively stopped at or proximate the stopper or guide 20 of the subject invention, the stopped sheets or sheet assemblies are laterally transferred or moved away from stopper or guide 20 to undergo various mail processing operations. Thus, pusher means are generally included with the invention, for laterally pushing the sheets or sheet assemblies away from the guiding means so that the stopped sheets may be inserted into envelopes, folded, transferred to another conveyor means, or undergo other various mail processing operations. As the presently preferred embodiment of the subject invention is utilized in conjunction with a conventional inserter I, the pusher means of the invention is preferably a pusher arm or inserter arm 110 (FIG. 6), which is mechanically interfaced with and driven by drive shaft 115 (FIGS. 4 and 6) on inserter I. The pusher means may alternatively be a pusher arm or other pushing member which is powered by a source other than a standard inserter, in situations where the present invention is not employed in conjunction with an inserter I. Referring more particularly to FIG. 6 and FIG. 9, pusher arm 110 preferably includes one or more pusher fingers 120*a–c* which laterally engage sheets or sheet assemblies to push the sheets laterally away from stopper 20, across the surface of plate 100, and towards a mail processing operation, which, in the embodiment described herein, is envelope insertion, with envelopes E for insertion being conveyed past pusher arm 110 and pusher fingers 120 by chain system B. It is also contemplated that stopper 20 could be movable, and the sheets or sheet assemblies could be pushed or otherwise moved onward over (or under) stopper 20, to other mail processing operations. Pusher fingers 120*a–c* are mounted on rods 125*a–c* respectively, which are pivotally attached to rod 130 on pusher arm 110. Lateral slots or grooves 132*a–c* may be included on plate 100, to accommodate pusher fingers 120*a–c*.

While the lower curved surface 32 of the hold-down button 30 of the subject invention effectively reduces or eliminates fanning or flaring of sheets associated with the leading edge of sheets in sheet assemblies, there still may exist some lateral flaring of sheets as the sheets are stopped. Lateral flaring of sheets is particularly a problem when the sheet assemblies have been folded for envelope insertion, as is illustrated generally in FIG. 7A (before and approaching the hold-down button 30) and FIG. 7B (beneath the hold-down button 30) wherein are shown sheet packets or assemblies which are folded along a right edge RE and fanned or flared out along a left edge LE of the sheet assemble. The lateral flaring of sheets may result in the edges of sheets being deflected over the pusher means and thus not pushed away from stopper 20, resulting in paper jams. Thus, means for containing or overcoming lateral flaring of sheets are generally included with the pusher means of the invention. Referring more particularly to FIG. 9, the containing means is preferably associated with the pusher fingers 120*a–c*, and comprises elongated, substantially vertical members 135*a–c* on pusher fingers 120*a–c*, each of which includes a substantially flat sheet-facing surface 140*a–c*. The elongated members 135*a–c* prevent flared edges of sheets from being deflected over the tops of pusher fingers 120*a–c* when pusher fingers 120*a–c* engage the lateral edge of sheets in sheet assemblies to push the sheets towards envelopes E on chain or belt B.

Accordingly, it will be seen that the present invention provides a sheet packet hold-down apparatus which prevents or contains fanning or flaring of sheets in moving sheet assemblies at the leading edge and a lateral edge of the sheets. Although the description above contains many specificities, these should not be construed as limiting the scope of the invention but as merely providing illustrations of some of the presently preferred embodiments of the invention. Thus, the scope of the invention should be determined by the appended claims and their legal equivalents.

What is claimed is:

1. An improved envelope filling machine, wherein the improvements comprise:

(a) guiding means for assisting in transferring a sheet packet into an envelope;

(b) a hold-down button of hemispherical section shape with a generally shallow angle of arc which is positioned proximate said guiding means; and (c) a dual bias means for resiliently supporting and biasing said hold-down button into nonrolling contact with said sheet packet as said packet is fed into an envelope.

2. An improved envelope filling machine according to claim 1, further comprising plate means for downward suspension of said hold-down button.

3. An improved envelope filling machine according to claim 1, further comprising conveyor means for transporting sheets to said guiding means.

4. An improved envelope filling machine according to claim 1, wherein said duel bias means comprises a first bias means and a second bias means for resiliently supporting said hold-down button, said second bias means associated with said first bias means.

5. An improved envelope filling machine according to claim 1, further comprising pusher means for pushing the sheets away from said guiding means.

6. An improved envelope filling machine according to claim 5, wherein said pusher means includes means for containing lateral flaring of sheets.

7. An improved envelope filling machine according to claim 6, wherein said pusher means comprises a pusher arm, said pusher arm including at least one pusher finger, said means for containing lateral flaring included on said pusher finger.

8. An improved envelope filling machine, wherein the improvements comprise:

(a) guiding means for assisting in transferring a sheet packet into an envelope;

(b) a hold-down button of hemispherical section shape with a generally shallow angle of arc, said hold down button positioned in front of said guiding means;

(c) a dual bias means for resiliently supporting and biasing said hold-down button into nonrolling contact with said sheet packet as said packet is fed into an envelope; and (d) conveyor means for transporting sheets to said guiding means.

9. An improved envelope filling machine according to claim 8, further comprising plate means for downward suspension of said hold-down button.

10. An improved envelope filling machine according to claim 8, wherein said duel bias means comprises a first bias means and a second bias means for resiliently supporting said hold-down button, said second bias means positioned adjacent said first bias means.

11. An improved envelope filling machine according to claim 8, further comprising pusher means for pushing sheets away from said guiding means.

12. An improved envelope filling machine according to claim 11, wherein said pusher means includes means for containing lateral flaring of sheets.

13. An improved envelope filling machine according to claim 12, wherein said pusher means comprises a pusher arm, said pusher arm including at least one pusher finger, said containing means included on said pusher finger.

14. An improved envelope filling machine according to claim 13, wherein said means for containing lateral flaring comprises an elongated, substantially vertical member, said substantially vertical member including a substantially flat sheet-facing surface.

15. An improved envelope filling machine, wherein the improvements comprise:

(a) guiding means for assisting in transferring a sheet packet into an envelope;

(b) a hold-down button of hemispherical section shape with a generally shallow angle of arc, said hold down button positioned in front of said guiding means;

(c) a dual bias means for resiliently supporting and biasing said hold-down button into nonrolling contact with said sheet packet as said packet is fed into an envelope;

(d) conveyor means for transporting sheets to said guiding means; and (e) plate means for downward suspension of said hold-down button, said plate means including an aperture, said hold-down button suspended through said aperture.

16. An improved envelope filling machine according to claim 15, wherein said duel bias means comprises a first bias means and a second bias means for resiliently supporting said hold-down button, said second bias means positioned adjacent said first bias means.

17. An improved envelope filling machine according to claim 15, further comprising pusher means for pushing sheets away from said guiding means.

18. An improved envelope filling machine according to claim 17, wherein said pusher means includes means for containing lateral flaring of sheets.

19. An improved envelope filling machine according to claim 18, wherein said pusher means comprises a pusher arm, said pusher arm including a plurality of pusher fingers, said containing means included on each of said pusher fingers.

20. An improved envelope filling machine according to claim 19, wherein said means for containing lateral flaring comprises an elongated, substantially vertical member, said substantially vertical member including a substantially flat sheet-facing surface.

21. An improved envelope filling machine according to claim 15, further comprising control means for monitoring operation of said pusher means.

22. An improved envelope filling machine, wherein the improvements comprise:

(a) guiding means for assisting in transferring a sheet packet into an envelope;

(b) a hold-down button, said hold down button positioned in front of said guiding means and having a hemispherical section shape with a generally shallow angle of arc;

(c) a dual bias means for resiliently supporting and biasing said hold-down button into nonrolling contact with said sheet packet as said packet is fed into an envelope;

(d) conveyor means for transporting sheets to said guiding means;

(e) plate means for downward suspension of said hold-down button, said plate means including an aperture, said hold-down button suspended through said aperture; and (f) pusher means for pushing sheets away from said guiding means, said pusher means including means for containing lateral flaring of sheets.

23. An improved envelope filling machine according to claim 22, wherein said duel bias means comprises a first bias means and a second bias means for resiliently supporting said hold-down button, said second bias means positioned adjacent said first bias means.

24. An improved envelope filling machine according to claim 22, wherein said pusher means comprises a pusher arm, said pusher arm including at least one pusher finger, said means included on said pusher finger.

25. An improved envelope filling machine according to claim 24, wherein said means for containing lateral flaring comprises an elongated, substantially vertical member, said substantially vertical member including a substantially flat sheet-facing surface.

26. An improved envelope filling machine according to claim 23, further comprising means for positionally adjusting said second bias means.

* * * * *